United States Patent [19]

Ruffini

[11] Patent Number: 4,486,641

[45] Date of Patent: Dec. 4, 1984

[54] INDUCTOR, COATING AND METHOD

[76] Inventor: Robert S. Ruffini, 3551 Crooks Rd., Royal Oak, Mich. 48073

[21] Appl. No.: 333,121

[22] Filed: Dec. 21, 1981

[51] Int. Cl.[3] ..... H05B 6/36

[52] U.S. Cl. ..... 219/10.79; 219/10.41; 219/9.5; 336/177; 174/35 R

[58] Field of Search ..... 219/9.5, 10.79, 10.41; 118/620, 624, 72, 402, 504, DIG. 5; 174/35 C, 35 E, 35 R, 35 M, 35 S, 32, 33, 36; 336/83, 177

[56] References Cited

U.S. PATENT DOCUMENTS

| | | | |
|---|---|---|---|
| 2,181,274 | 11/1939 | Jackson et al. | 219/10.49 |
| 2,553,690 | 5/1951 | Walsh | 174/36 |
| 2,844,489 | 7/1958 | Gemmer . | |
| 2,879,366 | 3/1959 | Tudbury | 219/10.79 |
| 2,882,378 | 4/1959 | Ticehurst | 219/10.69 |
| 2,974,059 | 3/1961 | Gemmer . | |
| 2,974,060 | 3/1961 | Dettling . | |
| 2,981,631 | 4/1961 | Nagel . | |
| 2,987,413 | 6/1961 | Dettling et al. . | |
| 2,998,840 | 9/1961 | Davis . | |
| 3,004,861 | 10/1961 | Davis . | |
| 3,017,485 | 1/1962 | Hansen | 219/10.79 |
| 3,028,251 | 4/1962 | Nagel . | |
| 3,032,816 | 5/1962 | Zimmerli . | |
| 3,085,034 | 4/1963 | Croeasant et al. . | |
| 3,090,696 | 5/1963 | Gemmer . | |
| 3,099,583 | 7/1963 | McLean . | |
| 3,140,195 | 7/1964 | Nagel . | |
| 3,167,454 | 1/1965 | Tompson | 118/DIG. 5 |
| 3,233,582 | 2/1966 | Sharetts et al. . | |
| 3,233,584 | 2/1966 | Angstadt . | |
| 3,260,611 | 7/1966 | Weidenhammer et al. . | |

(List continued on next page.)

FOREIGN PATENT DOCUMENTS

| | | |
|---|---|---|
| 272166 | 6/1927 | United Kingdom . |
| 645465 | 11/1950 | United Kingdom . |
| 704389 | 2/1954 | United Kingdom . |
| 916646 | 1/1963 | United Kingdom . |
| 932602 | 7/1963 | United Kingdom . |

OTHER PUBLICATIONS

The Polymer Corporation, Product Bulletin regarding Ferrotron 559H Ferromagnetic Plastic for Induction Hardening, (3 pp.).

GAF Brochure regarding Carbonyl Iron Powders, (28 pp.).

Rilsan Technical Bulletin regarding FPC Magnetic Compounds, Powder Processing–Compression Molding, (4 pp.).

Ferro Corporation, Ottawa Chemical Division, Specifications regarding Barium Ferrite Powder 106, (4 pp.).

Hoeganaes Corporation, Data Sheet regarding Powder Metallurgy Grades, (2 pp.).

3M Company, Product Information regarding Epoxy Powder, One Part, Unfilled, Rigid Resin, (4 pp.).

Rilsan Corporation, Brochure regarding Platamid Hot Melt Adhesives, (8 pp.).

3M Company, Technical Data regarding 3M Brand Porous Structures, (5 pp.).

*Primary Examiner*—C. L. Albritton

*Assistant Examiner*—M. M. Lateef

*Attorney, Agent, or Firm*—Harness, Dickey & Pierce

[57] ABSTRACT

A new inductor, coating, and method adapted to improve the directional control of magnetic flux of an inductor. The method may include using a fluidized bed or other like methods to coat an appropriately masked inductor with a coating composition comprised of a low reluctance material and a binder. The low reluctance material in the coating composition may include such materials as carbonyl iron powder or the like, whereas the binder may comprise a polymeric resin or the like. The present coating composition increases the directional control of magnetic flux, and efficiency of the inductor by selectively distorting the magnetic field and thereby increasing and intensifying the flux density on a subject workpiece being induction heated. The invention is also believed to be usable in improving directional control of magnetic flux in other electrical conductors.

10 Claims, 5 Drawing Figures

U.S. PATENT DOCUMENTS

| | | | |
|---|---|---|---|
| 3,264,131 | 8/1966 | Nagel . | |
| 3,264,371 | 8/1966 | Gruber et al. . | |
| 3,282,249 | 11/1966 | Ramsay . | |
| 3,309,217 | 3/1967 | Nagel . | |
| 3,338,863 | 8/1967 | Haag . | |
| 3,364,053 | 1/1968 | Beike . | |
| 3,403,241 | 9/1968 | Kauffman | 219/10.59 |
| 3,414,660 | 12/1968 | Beckius | 13/27 |
| 3,419,409 | 12/1968 | Dettling . | |
| 3,431,887 | 3/1969 | Pettigrew et al. . | |
| 3,440,078 | 4/1969 | Sharetts . | |
| 3,465,273 | 9/1969 | Brock | 336/62 |
| 3,483,058 | 12/1969 | Benz, Jr. . | |
| 3,503,823 | 3/1970 | Richart et al. . | |
| 3,704,336 | 11/1972 | Synnestvedt | 13/27 |
| 3,716,901 | 2/1973 | Bragg et al. | 29/436 |
| 3,785,046 | 1/1974 | Jennings | 29/602 |
| 3,798,059 | 3/1974 | Astle et al. | 336/200 |
| 3,812,442 | 5/1974 | Muckelroy | 336/83 |
| 3,863,764 | 2/1975 | Myslinski | 118/620 |
| 3,892,908 | 7/1975 | Lovness | 118/620 |
| 3,900,695 | 8/1975 | Andersson et al. | 13/26 |
| 3,992,690 | 11/1976 | Sperr, Jr. | 336/179 |
| 4,060,784 | 11/1977 | Fergestad | 336/84 R |
| 4,170,887 | 10/1979 | Baranov | 219/7.5 |
| 4,297,386 | 10/1981 | Gillette | 118/624 |
| 4,371,742 | 2/1983 | Manly | 174/36 |

INDUCTOR, COATING AND METHOD

BACKGROUND AND SUMMARY OF THE INVENTION

This invention relates generally to inductors, and more particularly to inductors used in induction heating.

Inductors or inductor coils are generally used to heat conductive material by currents induced by varying an electromagnetic field. Electromagnetic energy is transferred from the inductor to a workpiece. For purposes of analogy, if the inductor coil is considered to be the primary winding of a transformer, then the workpiece which is about to be heated would be considered the single-turn secondary. When an alternating current flows in the primary coil or inductor, secondary currents will be induced in the workpiece. These induced currents are called eddy currents and the current flowing in the workpiece can be considered as the summation of all of the eddy currents. Heat is generated in the workpiece by hysteresis and eddy current losses, with the heat generated being a result of the energy expended in overcoming the electrical resistance of the workpiece. Typically, close spacing is used between the inductor coil and the workpiece, and high coil currents are used to obtain maximum induced eddy currents and resulting high heating rates.

Induction heating is widely employed in the metal working industry to heat metals for soldering, brazing, annealing, hardening, forging, induction melting and sintering, as well as for other various induction heating applications. As compared to other conventional processes, induction heating has several inherent advantages. First, heating is induced directly into the material. It is therefore an extremely rapid method of heating. It is not limited by the relatively slow rate of heat diffusion in conventional processes using surface contact or radiant heating methods. Second, because of a skin effect, heating is localized and the area of the workpiece to be heated is determined by the shape and size of the inductor coil. Third, induction heating is easily controllable, resulting in uniform high quality of the product. Fourth, induction heating lends itself to automation, in-line processing, and automatic process cycle control. Fifth, start-up time is short, and thus standby losses are low or nonexistent. And sixth, working conditions are better because of the absence of noise, fumes, and radiated heat. Of course, there are also other advantages.

It is well known that the magnetic flux generated by the inductor must be dense enough to bring the workpiece to a desired temperature in a specified time (typically short). When the workpiece is simple in shape and can easily be surrounded by the inductor, rapid heating using a conventional inductor is a relatively simple task. However, when the workpiece is of a more complex shape, it becomes difficult to assure rapid and uniform heating in areas which are not readily accessible to the inductor.

In the past, it has been recognized that the performance of inductors may be improved by controlling the direction of flux flow and thereby manipulating and maximizing flux density on the workpiece. For example, with an inductor coil of generally circular cross-section, directional control might be improved by attaching magnetic field orienting elements on certain portions of the circumference, so that flux is intensified on the other portion or portions. Presently used field orienting elements include laminations made of grain-oriented iron (which are relatively thin pieces of strip stock) which are attached to the inductor on a strip by strip or layer by layer basis as necessary. These laminations, however, are unsatisfactory to the extent that they are difficult to apply, requiring cutting and sizing to the necessary configuration. Thus limited inductor cross-sections are coverable because of the difficulty of application. In this regard, it is very tedious and difficult to laminate such strip stock on to complicated geometrical shapes of the type which are often needed to treat certain types of workpieces. Applying such laminations to large inductors is also somewhat prohibitive due primarily to cost and labor considerations. In addition, these iron laminations have a tendency to lose permeability at high operating temperatures. This results in inefficient heat treating operations. At high temperatures, these materials require cooling due to relatively high hysteresis and eddy current losses. Laminations made of grain-oriented iron are also relatively expensive due to the labor costs required for manufacture.

Another conventional method of controlling the direction of inductor flux density is by the use of blocks or inserts made of ferromagnetic material in a binder. Although these materials perform well, they are all prefabricated and thus are available only in a specified number of shapes and sizes. Such blocks or inserts would typically be glued to the inductor as needed to increase flux density around the insert and consequently on the workpiece. Of course, the various prefabricated sizes may also be filed, sawed, drilled, laminated to one another, or machined to unlimited numbers of sizes, but this involves a considerable amount of labor on the part of the inductor manufacturer or user. Needless to say, such labor is expensive, and this expense would be in addition to the cost of the inserts themselves, which is by no means negligible.

Accordingly, it is a principal object of the present invention to provide an improved inductor which in addition to furnishing improved directional control, does so by utilizing an easy to apply coating on the inductor. Thus a more efficient inductor may be provided which does not require extensive labor to manufacture or use.

In general, the inductor, coating, and method of the present invention are adapted to improve the directional control of an inductor by increasing magnetic flux density in only designated areas, thereby increasing and intensifying flux density on a subject workpiece being heat treated. The method of the present invention includes using a fluidized bed or other like methods to coat an inductor with a coating composition. According to the present invention, the coating composition is comprised of a low reluctance material such as carbonyl iron powder or the like, and a binder such as a polymeric resin or the like. In carrying out the method of the present invention, a conventional fluidized bed apparatus may be used to apply the coating composition to an appropriately masked inductor. After coating, the masking, which may be comprised of such materials as teflon or aluminum foil, is removed. However, prior to removing the masking, the entire inductor assembly may be coated with a protective coating such as vinyl or the like to help prevent damage to the coating composition of the present invention. In addition, it is believed that the present invention is also usable in improving the directional control of magnetic flux in other electrical conductors. As noted above, coaing methods other than fluidized bed coating are also contemplated.

Additional advantages and features of the present invention will become apparent from a reading of the detailed description of the preferred embodiments which makes reference to the following set of drawings in which:

DESCRIPTION OF THE PREFERRED EMBODIMENTS

Figure 1:
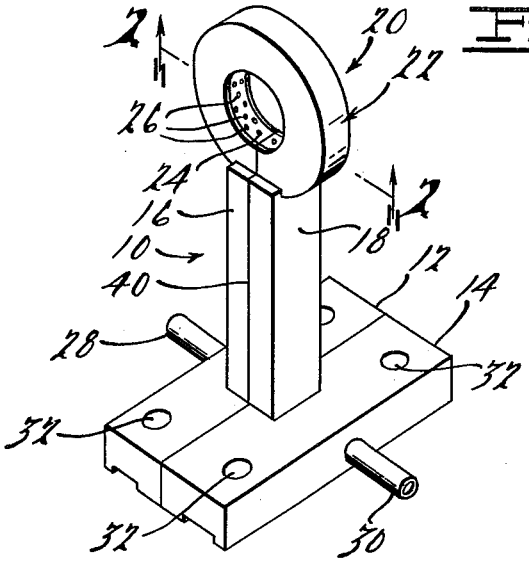
FIG. 1 is a perspective view of an inductor made in accordance with the present invention.

Referring now to the drawings wherein the showings are for the purpose of illustrating preferred embodiments of the present invention and are not for the purpose of limiting the invention, FIGS. 1 to 4 show an inductor 10 made in accordance with the present invention. (The inductor may be of any configuration and acceptable material.) The size and shape of the inductor 10 shown in FIGS. 1 to 4 is meant to be merely illustrative of an inductor coated in accordance with the present invention. It should be appreciated that the principles and spirit and scope of the present invention are applicable to an infinite number of inductor shapes and sizes.

The inductor 10 of FIG. 1 is comprised of base portions 12 and 14 having stem portions 16 and 18 connected thereto. A ring portion 20 is mounted on top of the stem portions. As will be explained in more detail hereinbelow, the ring portion 20 has a coating 22 thereupon which covers all but its inner surface 24, which has a series of water quench holes 26 therein. Quench holes 26 are used to quench or cool a workpiece (not shown) which would be placed inside the ring portion adjacent inner surface 24 and subjected to induction heat treatment. Quench water enters the inductor through inlet 28, proceeds through the inductor base portion 12, and through the stem portion 16, whereupon the quench water enters the ring portion 20 where much of the quench water exits the inductor through quench holes 26. Any remaining water proceeds down through stem portion 18 and base portion 14, and exits through outlet 30. Base portions 12 and 14, stem portions 16 and 18, as well as the ring portion 20 are fabricated from tubing or other hollow square or rectangular cross-sectioned stock so as to provide a path for the quenching water. Base portions 12 and 14, as shown herein, contain mounting holes 32 which are used to mount the inductor as necessary using bolts or the like.

Figure 2:
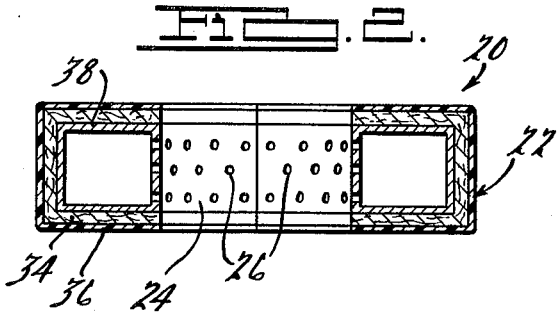
FIG. 2 is a cross-sectional view of the inductor of FIG. 1 along the line 2—2 of FIG. 1.
Figure 3:
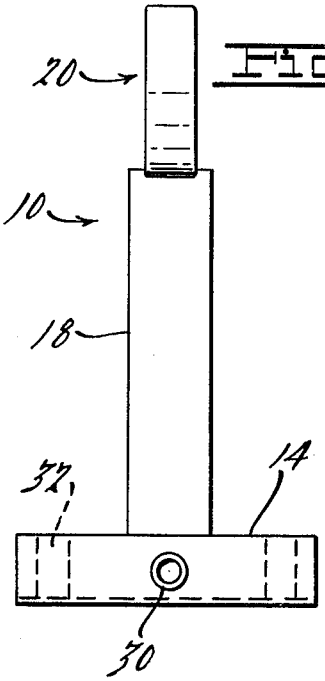
FIG. 3 is a side view of the inductor of FIG. 1.

FIG. 2 shows a cross-sectional view of the inductor ring portion 20 taken along the line 2—2 of FIG. 1. The coating 22 as depicted herein is made up of two layers, a first layer 34 which comprises the coating composition of the present invention and a second layer 36 which is a protective layer which covers or encapsulates the first layer. The coating composition 34 is comprised of a low reluctance material and a binder and, in this particular embodiment, is adhered directly to three of the four outer surfaces 38 of the ring portion 20. As mentioned above, the inner surface 24 of the ring portion is not covered with either the first or second coating layers 34 and 36 respectively, so as to keep water quench holes 26 free and exposed. Also, as noted above, the subject workpiece would be positioned within the ring portion adjacent this inner surface 24.

Figure 4:
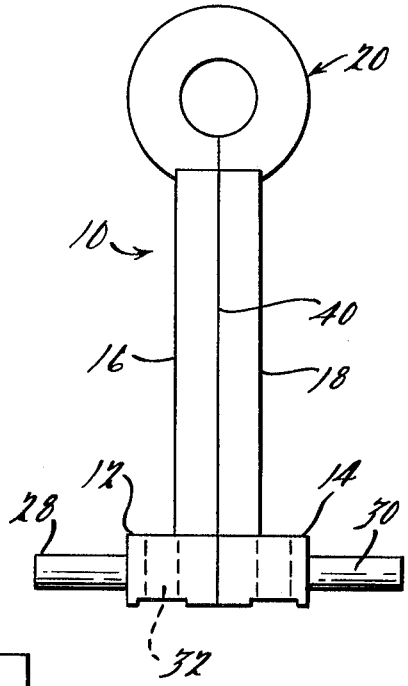
FIG. 4 is a front view of the inductor of FIG. 1.

FIGS. 1 and 4 both show the small gap 40 which exists between the respective base portions, stem portions, and opposing sides of the ring portion. This gap is present to prevent short-out between the adjacent surfaces of the stem portions. In carrying out the coating process of the present invention, both the gap 40 and the inner surface 24 of the ring portion 20 would be appropriately masked. For example, a teflon sheet might be inserted into the gap 40 to prevent coating, and aluminum foil might be applied to the inner surface 24 of the ring portion 20 so as to prevent coating thereof. Of course, other inductor configurations may require different masking techniques to provide the required coating configuration.

Figure 5:
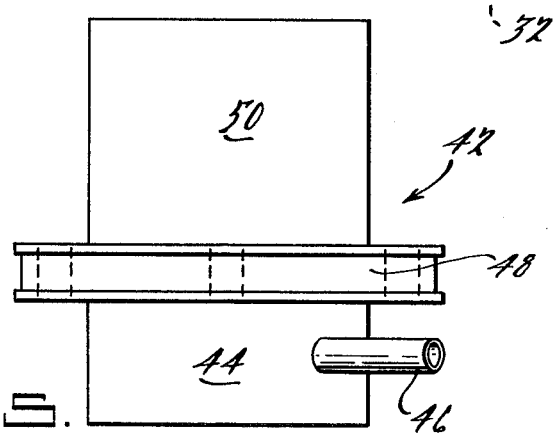
FIG. 5 is a schematic view of a fluidized bed apparatus of the type usable with the present invention.

FIG. 5 shows a fluidized bed apparatus 42 of the type usable in practicing the method of the present invention. The fluidized bed apparatus 42 (which is not drawn to scale herein and which is meant to represent any similar conventional fluidized bed apparatus usable in applying coating compositions or the like), includes a lower air manifold area 44 having an air inlet tube 46 therein, an intermediate porous structure 48, and an upper media portion 50. In operation, air flows from the lower air manifold area 44, upwardly through the intermediate porous structure 48, and causes media or pulverent material in the media portion 50 to become airborn or fluidized. In this regard, reference is made to the disclosure of U.S. Pat. No. 2,844,489 which relates to fluidized beds, and the disclosure of which is hereby incorporated by reference herein. Porous structures of the type sold by 3M Industrial Mineral Products Division under the designation POROUS STRUCTURES have been found to provide good performance.

In one embodiment of carrying out the method of the present invention, the following steps would be included. First, an inductor of conventional type would be provided. Next, those portions of the inductor which were not to be coated with the flux direction controlling coating composition of the present invention would be appropriately masked. It has been found that teflon or aluminum foil provide satisfactory performance at elevated coating temperatures, but other materials such as wood, steel, iron, other plastics, and the like, which furnish adequate masking properties at the coating conditions, are also believed to be usable. After the inductor has been masked as necessary, then the inductor would be heated to a temperature determined by the melting temperature of the binder in the coating composition of the present invention. Needless to say, a primer might be used to promote adhesion of a particular coating composition to an inductor, but this would vary with the inductor substrate and type of binder material in the coating composition. If necessary, the inductor surface may also be cleaned, etched, or sandblasted as an initial preparing step to help adhesion of the coating composition.

Following heating to the appropriate temperature, the heated masked inductor would be placed in a fluidized bed wherein a coating composition made in accordance with the present invention would be applied thereto in a conventional manner. A continuous coating would be applied over the inductor surface except at the portion of the inductor where improved flux density is desired. (Needless-to say, the base, stem, or other support portions of the inductor would not be coated.) Of course, after a sufficient coating has been applied, then the inductor would be removed from the fluidized bed. For example, a heated inductor may have to be placed in the fluidized bed media for about 1 to 2 minutes until it is sufficiently coated with the coating composition of the present invention. Of course, coating time varies with the particular coating composition, coating thickness, and the like. Prior to removing the masking, an inductor coated as described above may be further coated with a conventional protective coating such as vinyl by similar treatment in fluidized bed media.

Although fluidized bed coating has been described above in connection with one preferred embodiment of the present invention, it is also believed that the principles of the present invention are equally applicable to other conventional coating methods including electrostatic spraying, dipping, casting, melting, vacuum forming, painting, compression molding, and injection molding (both on to and around the substrate). In addition, it is believed that the coating process and composition of the present invention which have been described above in connection with inductors may also be equally applicable to other electrical conductors where improved directional control of magnetic flux is desired.

The coating composition of the present invention which is used in accordance with the inductor and method of the present invention is comprised of a low reluctance material and a binder. Between about 90% to about 95% by volume low reluctance material mixed with about 10% to about 5% by volume binder is suitable to provide a satisfactory coating. Of course, other ratios may also provide satisfactory performance. However, it should be appreciated that in order to optimize the performance of the coating composition of the present invention, that it is desirable to maximize the amount of low reluctance material and minimize the amount of binder so as to minimize the spacing or gaps between the low reluctance particles. Typical of a material suitable for use as the low reluctance material is the carbonyl iron powder manufactured by GAF Corporation and sold in powdered form under the designation "Hi-Perm Type E". Other materials also believed to be usable include GAF Corporation "Type SF" and "Type W" carbonyl iron powders, nylon coated barium ferrite powders such as those sold by Rilsan Corporation of Glen Rock, N.J. under the name "FPC powder"; barium ferrite powders such as those sold by Ferro Corporation, Ottawa Chemical Division of Toledo, Ohio under the designation "Barium Ferrite Powder 106"; iron and steel powders such as those sold by Hoeganaes Corporation of Riverton, N.J. under the designations "Anchor", "Ancormet", or "Ancorsteel"; magnetic ceramic powders of the type obtainable from the Stackpole Corporation of St. Marys, Pa. under the designation "Ceramag 248.0244"; as well as other equivalent materials and mixtures. Thus the low reluctance material may be at least one material selected from the group consisting of carbonyl iron powders, barium ferrite powders, iron powders, steel powders, magnetic ceramic powders, as well as mixtures thereof.

The binder may be a polymeric resin of a type suitable to hold the low reluctance powder together as well as to adhere the entire coating to the inductor surface. Typical of a material suitable for use as the binder is the epoxy powder, one part, unfilled, rigid resin of the type sold by 3M as "Scotchcast Electrical Resin 265". Other materials also believed to be usable include hot melt adhesives of the type sold by Rilsan Corporation of Glen Rock, N.J. under the designation "Platamid" hot melt adhesives, as well as other equivalent materials and mixtures. Thus the binder may be at least one material selected from the group consisting of thermoplastic resins, thermosetting resins, and hot melt adhesives, as well as mixtures thereof.

Coating thicknesses of from about a few thousandths of an inch (i.e., about 0.005) to about $\frac{1}{4}$ inch or more should be usable in practicing the present invention. In the examples below, a thickness of about 0.100 was found suitable. Of course, the thickness of the coating will probably vary depending on such factors as the type of low reluctance material used, the type of binder used, and inherent strength of the coating composition, the amount of flux control desired, the duration of the immersion time in the fluidized bed, and the like. As a general rule, the flux controlling efficiency, as described herein, increases as coating thickness increases.

In order to further illustrate the new inductor, coating, and method of the present invention, the following examples are provided. It will be understood that these examples are provided for illustrative purposes and are not intended to be limiting of the scope of the invention as herein described and as set forth in the subjoined claims.

EXAMPLES

An inductor of the type shown in FIGS. 1 to 4 (made of copper and about eight inches in overall height) was coated using a fluidized bed apparatus of the type shown in FIG. 5. A coating comprised of 90% by volume low reluctance material (GAF carbonyl iron powder, "Hi-Perm Type E") and 10% by volume binder (3M Scotchcast Electrical Resin 265) was applied to a thickness of about 0.100 inch. The inductor was previously cleaned using sandblasting with glass beads, also commonly known as glass bead pelletizing. The gap 40 and inner surface 24 of the ring portion of the inductor were masked using adhesive backed aluminum foil and teflon as described hereinabove, and the inductor was heated to about 450° F. The ring portion of the masked inductor was placed in the fluidized bed for about 1 minute and removed. (The base and stem portions were not placed in the fluidized bed and thus were not coated.) After cooling, the coated inductor was further coated in the fluidized bed with a thin layer of vinyl (about 0.010 inch) to prevent damage to the coating during handling. Seven steel rods (4140 steel) approximately 1 inch diameter and about six inches long were subjected to heat treatment using an induction generator providing a 10 KHz frequency over a 0.060 inch air gap to the steel rod.

Test results comparing workpieces (the steel rods referred to above) induction heat treated with an inductor having no coating (Workpiece No. 1) versus rods induction heat treated with an inductor coated in accordance with the present invention as described above (Workpieces Nos. 2 to 7) are given below. Two tests were run on each rod and are averaged below.

| Workpiece No. | % Volts (of 100) | % Amps (of 100) | % Kilowatts (of 150) | KVAR* | Case Hardening Depth (Avg.) | Difference | % Increase Of Case depth | % Decrease of Power |
|---|---|---|---|---|---|---|---|---|
| 1 (uncoated inductor) | 30 | 68 | 10 | −8 | .216 | — | — | — |
| 2 (coated inductor) | 30 | 71 | 11 | −7 | .245 | +.029 | +.134 | +10. |
| 3 (coated inductor) | 28 | 69 | 10 | −6 | .233 | +.017 | +.0787 | −6.666 |
| 4 (coated inductor) | 26 | 67 | 8 | −5 | .207 | −.009 | −.0416 | −13.333 |
| 5 (coated inductor) | 24 | 64 | 8 | −4 | .188 | −.028 | — | — |
| 6 (coated inductor) | 22 | 61 | 6 | −3 | .160 | −.056 | — | — |
| 7 (coated inductor) | 20 | 59 | 6 | −2 | .146 | −.070 | — | — |

*KVAR = Kilovolt ampere rating

From the above test results it should be apparent that in comparing an uncoated inductor with one coated in accordance with the present invention, that similar case hardening depths were achieved with Workpiece No. 1 (using an uncoated inductor), and Workpiece No. 4 (using an inductor coated in accordance with the present invention). This same case hardening depth was achieved with Workpiece No. 4 using about 20% less power than that needed with Workpiece No. 1 (comparing % Kilowatts for Workpieces Nos. 1 and 4). By any standard, it is believed that a 20% power savings is a significant energy saving achievement.

Among the advantages of the present invention, in addition to those described hereinabove, is that if one desired not to reduce power in an inductor coated in accordance with the present invention, then case hardening depths similar to those obtained with an uncoated inductor could be achieved in significantly less time due to the direction controlling and flux intensifying properties of the present invention. In any event, better control of the overall induction heat treating process is achieved. Also, unlike the difficult to apply laminations and inserts presently used, more complex coil constructions are able to be covered with a flux direction controlling material, due to the easy application of the coating composition of the present invention. This presents unlimited opportunities to inductor users whose inductors were either too large or too complicated in shape to even consider covering in some way in the past. Substantial efficiencies should result using the inductor, coating, and method of the present invention, with accompanying energy and labor savings as well.

While it will be apparent that the preferred embodiments of the invention disclosed are well calculated to fulfill the objects above stated, it will be appreciated that the invention is susceptible to modification, variation, and change without departing from the proper scope or fair meaning of the subjoined claims.

What is claimed is:

1. A method of coating an inductor for induction heating of a workpiece to improve directional control of magnetic flux of the inductor comprising:

(a) providing an inductor having a first surface for positioning adjacent the workpiece, (b) covering said first surface with masking, (c) heating the masked inductor, (d) placing the masked inductor in a fluidized bed, (e) applying to the masked inductor in the fluidized bed a coating composition comprised of a low reluctance material and a binder, and (f) removing the coated inductor from the fluidized bed.

2. The method of claim 1 which further comprises the step of removing the masking from the inductor.

3. The method of claim 1 which further comprises an initial step of preparing the inductor surface.

4. The method of claim 1 wherein said preparing step includes at least one step selected from the group consisting of cleaning, etching, and sandblasting the inductor surface.

5. The method of claim 1 wherein said masking is at least one material selected from the group consisting of teflon and aluminum foil.

6. The method of claim 1 wherein said coating composition comprises between about 90% to about 95% low reluctance material and between about 10% to about 5% binder.

7. The method of claim 1 wherein said low reluctance material is at least one material selected from the group consisting of carbonyl iron powders, barium ferrite powders, iron powders, steel powders, and magnetic ceramic powders, as well as mixtures thereof.

8. The method of claim 1 wherein said binder is at least material selected from the group consisting of thermoplastic resins, thermosetting resins, and hot melt adhesives, as well as mixtures thereof.

9. The method of claim 1 which further comprises the step of applying a protective coating to the coated inductor.

10. The method of claim 9 wherein said protective coating comprises vinyl.

* * * * *

UNITED STATES PATENT AND TRADEMARK OFFICE

CERTIFICATE OF CORRECTION

PATENT NO. : 4,486,641

DATED : December 4, 1984

INVENTOR(S) : Robert S. Ruffini

It is certified that error appears in the above-identified patent and that said Letters Patent is hereby corrected as shown below:

On the title page

References Cited U.S. PATENT DOCUMENTS Page 2, add

--2,105,070 1/1938 Bandur
2,238,382 4/1941 Boegehold
2,977,263 3/1961 Harendza-Harinxma
3,014,825 12/1961 Harendza-Harinxma
3,231,648 1/1966 Eyre et al
3,562,205 2/1971 Richart
3,645,960 2/1972 Haag
3,666,571 5/1972 Laing
3,848,331 11/1974 Pavlik et al
4,019,239 4/1977 Bockstiegel
4,158,581 6/1979 Krause et al
4,177,089 12/1979 Bankson
4,216,017 8/1980 Carcey
4,248,977 2/1981 Wertz
4,260,582 4/1981 Kumar et al
4,271,114 6/1981 Ohno
4,282,174 8/1981 Chase et al
4,320,080 3/1982 Esper et al--

Column 3, line 2, delete "coaing" and substitute therefor --coating--.

Signed and Sealed this

*Twenty-fifth* Day of *June 1985*

[SEAL]

*Attest:*

DONALD J. QUIGG

*Attesting Officer* *Acting Commissioner of Patents and Trademarks*